US005766093A

United States Patent [19]

Rohrer

[11] Patent Number: 5,766,093

[45] Date of Patent: Jun. 16, 1998

[54] GOLF PUTTERHEAD

[76] Inventor: John W. Rohrer, 49 Long Cove Rd., York, Me. 03909

[21] Appl. No.: 608,674

[22] Filed: Feb. 29, 1996

[51] Int. Cl.[6] ..... A63B 53/04

[52] U.S. Cl. ..... 473/329; 473/332; 473/340; 473/342

[58] Field of Search ..... 473/340, 342, 473/329, 332, 251, 238, 236, 226, 219, 288, 280

[56] References Cited

U.S. PATENT DOCUMENTS

| | | | |
|---|---|---|---|
| 3,061,310 | 10/1962 | Giza | 473/340 |
| 3,211,455 | 10/1965 | Hyden | 473/329 |
| 3,578,332 | 5/1971 | Caldwell . | |
| 3,679,207 | 7/1972 | Florian . | |
| 3,843,122 | 10/1974 | Florian | 473/329 |
| 4,156,526 | 5/1979 | Huggins et al. . | |
| 4,422,638 | 12/1983 | Tucker . | |
| 4,569,524 | 2/1986 | Quijano | 473/342 |
| 4,754,969 | 7/1988 | Kobayashi . | |
| 4,869,507 | 9/1989 | Sahm . | |
| 4,872,683 | 10/1989 | Doran . | |
| 5,058,895 | 10/1991 | Igarashi . | |
| 5,078,398 | 1/1992 | Reed et al. . | |
| 5,083,778 | 1/1992 | Douglas . | |
| 5,332,214 | 7/1994 | Tucker | 473/329 |
| 5,405,136 | 4/1995 | Hardman | 473/342 |
| 5,407,196 | 4/1995 | Busnardo . | |
| 5,489,094 | 2/1996 | Pritchett | 473/342 |
| 5,529,543 | 6/1996 | Beaumont | 473/329 |

FOREIGN PATENT DOCUMENTS

| | | | |
|---|---|---|---|
| 2124910 | 2/1984 | United Kingdom | 273/167 J |

OTHER PUBLICATIONS

Pelz, Dave, *Golf Magazine:* 64 (Aug. 1994).

*Primary Examiner*—Sebastiano Passaniti
*Attorney, Agent, or Firm*—Kevin M. Farrell

[57] ABSTRACT

Disclosed is a golf club head, preferably a putterhead, comprising a striking face with an intended strikepoint, and a variable energy absorbing device incorporated such that maximum energy is absorbed when a golf ball is struck on the intended strikepoint and progressively less energy is absorbed as the ball is struck on the striking face at distances incrementally remote from the intended strikepoint along a horizontal axis. In a preferred embodiment, the variable energy absorbing device comprises a viscoelastic absorbing material of varying thickness embedded in the putterhead, the thickness of the viscoelastic material along an axis perpendicular to the plane of the striking face being thickest at the intended strikepoint, and progressively less thick at distances incrementally remote from the intended strikepoint along a horizontal axis.

5 Claims, 2 Drawing Sheets

GOLF PUTTERHEAD

BACKGROUND OF THE INVENTION

Golfers and club designers have long recognized the advantages of clubs and putters with such undefined characteristics as "good feel" and "enlarged sweetspots." Some putter designers have used such methods as severe toe and heel weighting (creating high rotational moments of inertia around the putterhead center of gravity) to slightly reduce, but not eliminate, the effects of mishits on both distance loss and misdirection. "Mishits" as used herein occur when the actual ball strikepoint on the putter face occurs at some distance from the intended strikepoint. Others have used a uniform milled or cast slot behind the putterhead striking face to improve feel on mishits. However, such designs provide little or no actual distance loss or misdirection improvement. Still others have used non-metalic inserts generally made of materials as soft as or softer than a golf ball to absorb impact vibrations and improve feel, again without improvement in mishit distance loss or misdirection.

Scientific test results on popular putters using a putting robot were published in 1994 (Peltz, *Golf Magazine* Aug. 8, 1994: 64–65). This study quantified large distance losses resulting from mishits on the striking face. Toe/heel average distance loss for a ⅛ inch mishit on a 27 foot putt ranged from 2.85 feet (10.55%) for the worst designs (classical blades) to 1.85 feet (6.85%) for better designs (mallet head). It was determined through such testing that doubling the mishit distance (e.g., to ¾ inch) approximately tripled the observed distance loss.

Golfers are, to a large extent, generally unaware of their average and maximum mishits during a round of golf. Large mishits are more likely on longer putts and, unfortunately, lead to the greatest percentage distance loss just when it is most critical to get the ball close to the hole to avoid 3 putt greens. It has been reported that ¾ inch mishits were not uncommon among average players and even accomplished players often have mishits greater than ⅛ inch. This data was determined through the use of impact decals affixed to the strikingface of putterheads.

Numerous putter designs have been patented and/or marketed which have incorporated resilient or flexible face plates to either improve feel (i.e. absorb high frequency vibration) or enlarge the sweet spot (i.e., the intended strikepoint) by making a hard face more flexible (e.g., via slotting). Slots cast or milled behind the face plate to allow deflection and thus enlarge the sweet spot have also been employed.

However, none of the prior art putterhead designs eliminate or substantially reduce distance loss and misdirection associated with mishit putts. A putterhead design which minimizes the distance loss and misdirection associated with mishit putts would represent a substantial improvement in putterhead design. In addition, although Applicant is unaware of published test results conducted with golf clubs other than putters, the principles discussed above in connection with putters is equally applicable to other golf clubs (e.g., woods, irons and utility clubs).

SUMMARY OF THE INVENTION

The present invention relates to a golf club head, preferably a putterhead, comprising a striking face with an intended strikepoint, and a variable energy absorbing means incorporated such that maximum energy is absorbed when a golf ball is struck on the intended strikepoint and progressively less energy is absorbed as the ball is struck on the striking face at distances incrementally remote from the intended strikepoint along a horizontal axis.

DESCRIPTION OF PREFERRED EMBODIMENTS

Figure 1:
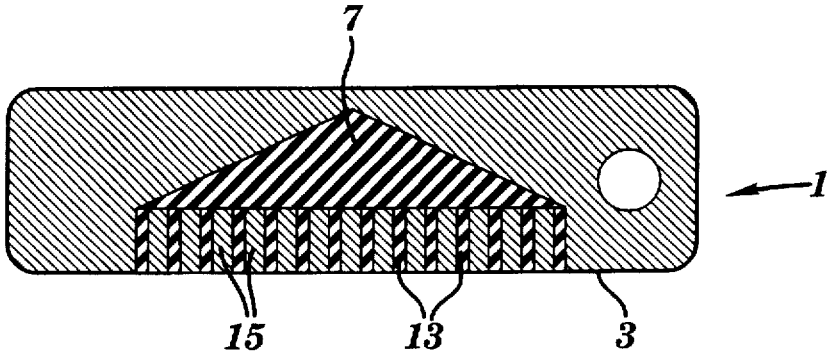
FIG. 1 is a top cross-sectional view of a putterhead of the present invention wherein the viscoelastic material is in communication with the striking face of the putterhead through a plurality of vertically oriented rigid striking elements separated by elastic or viscoelastic material.

The subject invention relates to a golf club head which minimizes or eliminates mishit distance loss and/or misdirection. While the discussion which follows is directed primarily toward the putter, it will be recognized that the principles apply and are applicable to all golf clubs (e.g., woods (including metal woods), irons, and utility clubs such as chippers).

Golf putterheads are designed with an intended strikepoint on the striking face of the club. The intended strikepoint is defined as that point at which ball travel distance is maximized when balls are struck at constant velocity. This point is found between the putterhead center of gravity and the putter shaft longitudinal axis. As stated above, it is generally recognized that mishits (i.e., putts in which the golf ball is struck at a point other than the intended strikepoint on the striking face) result in both distance loss and misdirection. The present invention minimizes or eliminates the detrimental effects of distance loss and misdirection by incorporating an energy absorbing means in the putterhead.

More specifically, the present invention relates to a putterhead which incorporates a variable energy absorbing means. The variable energy absorbing means is designed such that maximum energy is absorbed as the ball is struck on the intended strikepoint, and progressively less energy is absorbed as the ball is struck further from the intended strikepoint along a horizontal axis within the "working section" of the striking face. While the working section can, of course, encompass the entire striking face, in preferred embodiments the working section is general ±½ inch to ±1 inch on either side of the intended strikepoint.

The variable energy absorbing embodiments specifically described herein utilize concurrent putterhead striking face deflection and energy absorption (i.e., the tendency of the striking face to deform upon contact with a golf ball and absorb energy) to minimize or eliminate the distance loss and misdirection problems associated with mishit putts. In general, embodiments which exhibit striking face deflection and energy absorption can be designed using a viscoelastic elastomer material incorporated into the design. Some elastomers are viscoelastic, absorbing energy well, while others of comparable flexibility are more purely elastic.

With respect to elastomeric inserts in embodiments which require striking face deflection, preferred elastomeric materials have a hardness which is less than the hardness of a golf ball. Golf ball hardness can be quite variable. In fact, golf balls are specifically marketed in varying compression specifications and cover hardness. For purposes of the present invention it can be assumed that golf ball hardness can range between about 70 to about 100 Durometer A. Preferred ranges for elastomeric hardness for the subject invention are between 35–90 Durometer A.

The effect of incorporating the energy absorbing means in the putterhead design is that balls struck on the intended strikepoint encounter maximum energy absorption, whereas balls struck at points on the striking face other than the intended strikepoint encounter progressively less energy absorption at distances incrementally remote from the intended strikepoint along a horizontal distances (i.e., toward the heel or the toe). The net effect of this design is that balls struck with a substantially identical putterhead velocity travel substantially the same distance irrespective of the point on the striking face where the ball is contacted.

In addition, to minimizing the distance penalty associated with mishits, the putterhead design of the present invention also tends to correct misdirection which is introduced by mishits. When a golf ball is struck on the striking face of the putterhead at a point other than the intended strikepoint, misdirection (initial ball direction which is non-normal to the to the strikingface) results. Like distance loss, misdirection is caused by angular acceleration and rotation of the putterhead at impact around the intended strikepoint which is at or near the club head center of gravity in most putterheads.

Referring to FIG. 1, a putterhead (1) of the present invention is shown. The putterhead has a striking face (3) and an intended strikepoint (5). The hosel (2), or socket in the putterhead which accepts the club shaft, is also illustrated. While the shape of the putterhead of FIG. 1 is a classical "blade" design, the overall shape of the putterhead is not critical with respect to embodiments of the present invention. For example, the design of the putterhead of the present invention can be a conventional "blade" design, a toe and heel weighted design or an asymmetrical "mallet" design. The body of the putterhead can be made of any of the currently employed materials (e.g., brass, stainless steel, aluminum, graphite, ceramics, resins, etc.).

In FIG. 1, viscoelastic material (7) is in communication with the striking face (3) of the putterhead (1) through a plurality of vertically oriented striking plates (15). The major plane of the vertically oriented striking plates is perpendicular to the striking face (3) of the putterhead. The striking plates are comprised of a rigid material (e.g., brass, stainless steel, resin, etc.) and the widths of the striking plates (from front to back and side to side) can be fixed or variable. In a preferred embodiment, the vertically oriented striking plates (15) are insulated from adjacent vertically oriented striking plates by an elastomeric material (13) which is more resilient than the viscoelastic material (7). Alternatively, the viscoelastic material (7) can also be used as the insulating material (13).

Figure 2:
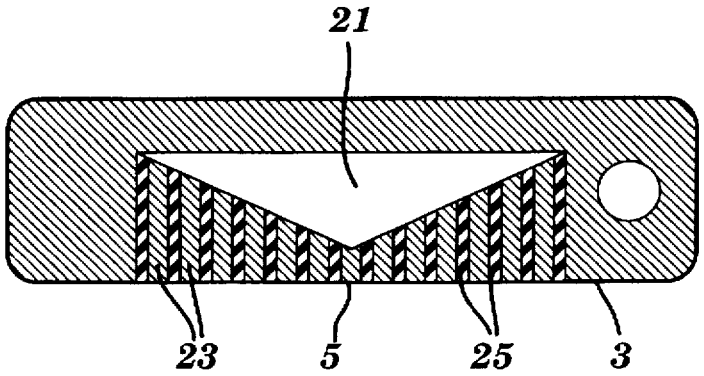
FIG. 2 is a top cross-sectional view of a putterhead of the present invention wherein the variable energy absorbing means is the viscoelastic layers between a plurality of vertically oriented rigid striking elements, said elements being of variable length with a void space or viscoelastic material behind said elements, allowing greatest deflection and energy absorption at the center.

Referring to FIG. 2, the viscoelastic material described in connection with the embodiment of FIG. 1 can be replaced with a void (21). The void is in communication with the striking face of the putterhead through a plurality of vertically oriented striking plates (23). The major plane of the vertically oriented striking plates being oriented perpendicular to the striking face of the putterhead. The vertically oriented striking plates are attached to adjacent vertically oriented striking plates by a viscoelastic material (25).

Figure 3:
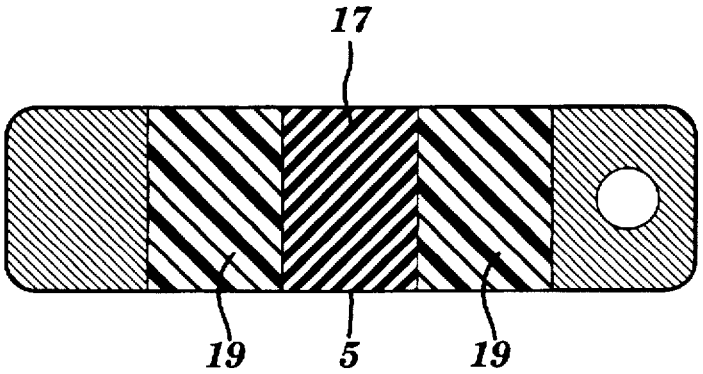
FIG. 3 is a top cross-sectional view of a putterhead of the present invention wherein variable energy absorption is effected by arranging a plurality of striking elements along the striking face, the striking elements comprised of two or more materials having differing energy absorbing properties, or variable absorption properties, absorption properties being greatest at the center.
Figure 4:
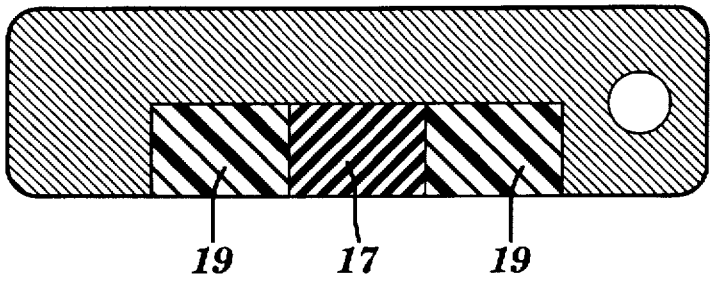
FIG. 4 is a top cross-sectional view of a putterhead of the present invention wherein variable energy absorption is effected by arranging a plurality of striking elements along the striking face, the striking elements being contained within a rigid putterhead and being comprised of materials having differing energy absorbing properties, or variable energy absorbing properties being greatest at the center.

Variable energy absorption can be accomplished by laminating elastomers having differing energy absorption properties to form a plurality of vertically oriented striking elements comprised of elastomeric materials of varying viscoelasticity. Referring to FIG. 3, the putterhead is comprised of a first vertically oriented striking element (17) comprised of a first viscoelastic material, and a set of second vertically oriented striking elements (19) comprised of a second viscoelastic material flanking the first vertically oriented striking element. In this embodiment, maximum energy absorption at the intended striking point (5), is accomplished by selecting a viscoelastic material for the first vertically oriented striking element (17) which exhibits greater energy absorption than the viscoelastic material selected for the second vertically oriented striking elements (19). The total number of striking elements can be variable. In addition, the striking elements can be of varying width (side to side) and thickness (front to back). For example, FIG. 4 shows an alternative embodiment wherein the vertically oriented striking elements (17 and 19) are shown with the same width as in the embodiment of FIG. 3, however the thickness has been reduced substantially. A homogenous insert material with varying viscoelastic properties can also be used in lieu of discrete laminates. A ball is struck at some distance from the intended strike point. Maximum energy absorption would occur at the intended strike point due to the fact that the elastomeric insert material is thickest at this point and the ball would achieve maximum deflection into the viscoelastic material before rebound initiates. Upon impact with a golf ball, the viscoelastic insert deforms rearwardly momentarily. Rebound of the viscoelastic material imparts forward motion to the golf ball. At distances incrementally remote from the intended strike point, deflection, and consequently energy absorption, is reduced due to the fact that the viscoelastic material is thinner which tends to reduce energy absorbing deflection. Misdirection is also at least partly corrected because less energy is absorbed (more rebound occurs) on the portion of the ball furthest from the intended strike point causing the ball to rebound at an angle non-normal to the striking face.

Figure 5:
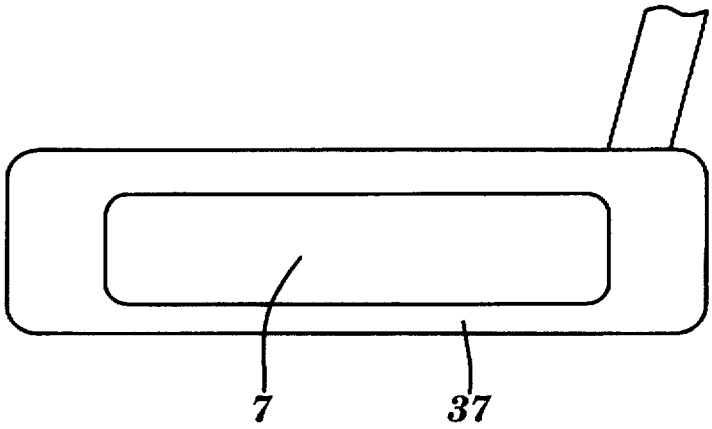
FIG. 5 is a front view of a putterhead of the present invention wherein the viscoelastic insert, and any optional cover layer, is fully surrounded by the rigid putterhead material to better protect the energy absorbing systems from accidental damage.

For additional protection, the viscoelastic insert (7) can be fully surrounded by the rigid putterhead material (37) as illustrated in FIG. 5.

What is claimed is:

1. A putterhead comprising a striking face with an intended strikepoint, and a variable energy absorbing means comprising a viscoelastic energy absorbing material of varying thickness embedded in the putterhead, the thickness of the viscoelastic material along an axis perpendicular to the plane of the striking face being thickest at the intended strikepoint, and progressively less thick at distances incrementally remote from the intended strikepoint along a horizontal axis, the viscoelastic material being in communication with the striking face of the putterhead through a plurality of vertically oriented striking plates, the major plane of the vertically oriented striking plates being oriented perpendicular to the striking face of the putterhead, the vertically oriented striking plates being insulated from communication with adjacent vertically oriented striking plates.

2. A putterhead of claim 1 wherein the vertically oriented striking plates are insulated from adjacent vertically oriented striking plates by a void space.

3. A putterhead of claim 1 wherein the vertically oriented striking plates are insulated from adjacent vertically oriented striking plates by an elastic or viscoelastic material.

4. A putterhead comprising a striking face with an intended strikepoint, and a variable energy absorbing means incorporated such that maximum energy is absorbed when a golf ball is struck on the intended strikepoint and progressively less energy is absorbed as the ball is struck on the striking face at distances incrementally remote from the intended strikepoint along a horizontal axis, the variable energy absorbing means comprising a void in the putterhead, the thickness of the void along an axis perpendicular to the plane of the striking face being thickest at the intended strikepoint, and progressively less thick at distances incrementally remote from the intended strikepoint along a horizontal axis, the void being in communication with the striking face of the putterhead through a plurality of vertically oriented striking plates, the major plane of the vertically oriented striking plates being oriented perpendicular to the striking face of the putterhead, the vertically oriented striking plates being insulated from communication with adjacent vertically oriented striking plates by a viscoelastic energy absorbing material.

5. A putterhead comprising a striking face with an intended strikepoint wherein the striking face comprises a plurality of adjacent vertically oriented striking elements, the vertically oriented striking elements comprised of different viscoelastic materials of predetermined and varying energy absorption, energy absorption being greatest at the intended center strikepoint, the variable energy absorption elements cooperating to equalize the distance a golf ball travels when struck at the intended strikepoint, or points on the striking face remote from the intended strikepoint, with an otherwise identical stroke.

* * * * *